United States Patent [19]

Troup

[11] Patent Number: 4,535,920

[45] Date of Patent: Aug. 20, 1985

[54] APPARATUS FOR APPLYING LAP SEALANT

[76] Inventor: Leon M. Troup, 601 Hampton St., Marquette, Mich. 49855

[21] Appl. No.: 537,842

[22] Filed: Sep. 30, 1983

[51] Int. Cl.[3] ..... B67D 5/00; B67D 3/00

[52] U.S. Cl. ..... 222/612; 222/513; 222/517; 222/536; 239/579; 427/286

[58] Field of Search ..... 222/608, 611, 612, 617, 222/174, 529, 530, 536, 511, 513, 516, 517, 533; 239/537, 538, 579, 150; 118/305, 323; 180/19.1; 404/107

[56] References Cited

U.S. PATENT DOCUMENTS

| | | | |
|---|---|---|---|
| 1,709,091 | 4/1929 | Nissly | 239/150 |
| 1,924,636 | 8/1933 | Burket | 404/107 |
| 1,953,200 | 4/1934 | Thomas | 222/536 |
| 2,211,260 | 8/1940 | Donald | 180/19.1 |
| 3,272,399 | 9/1966 | Dight | 222/517 |

*Primary Examiner*—Joseph J. Rolla
*Assistant Examiner*—Andrew Jones
*Attorney, Agent, or Firm*—Edward D. Gilhooly

[57] ABSTRACT

An apparatus for applying lap sealant including a frame having wheels and supporting a container of lap sealant and a pressurized agent for delivering the sealant to a nozzle. The nozzle is positioned beyond the side of one wheel to permit a lap seam to be accurately followed.

8 Claims, 5 Drawing Figures

FIG. 1
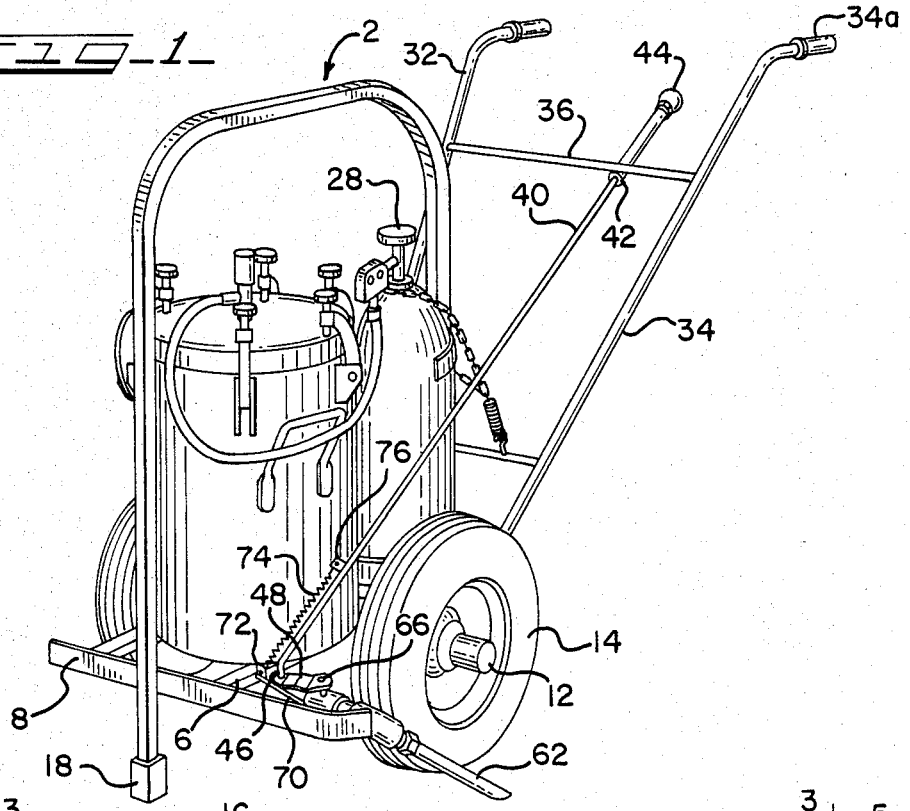
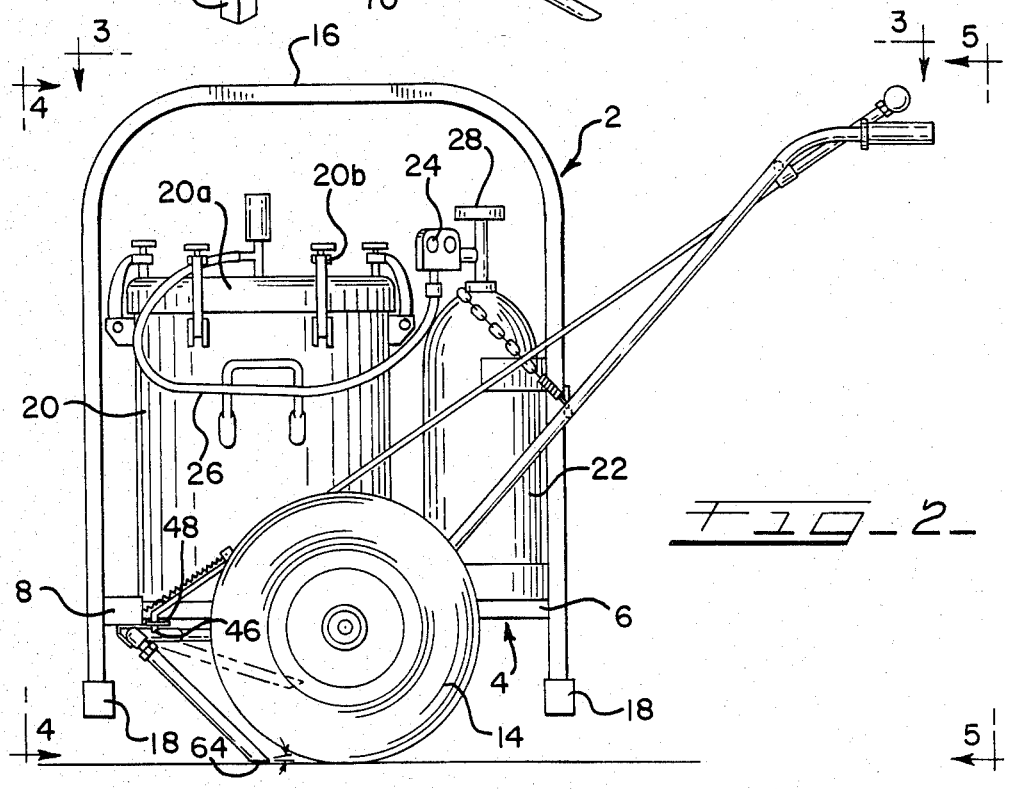
FIG. 2

APPARATUS FOR APPLYING LAP SEALANT

BACKGROUND OF THE INVENTION

This invention relates, in general, to roofing apparatus and, in particular, to an apparatus for applying lap sealant.

More specifically, without restriction to the particular use which is shown and described, this invention relates to an apparatus for applying lap sealant having a unique frame that is supported on wheels and carries a supply of lap sealant and a pressurized agent for delivering the sealant to a nozzle. The nozzle is positioned along the side of one of the wheels of the apparatus to enable the user visually to observe the application of sealant compound to a seam. The apparatus of the invention provides for increased efficiency and effectiveness of applying a lap sealant with significant savings in cost and time for completing a particular roofing installation.

One kind of roofing now commonly utilized employs the positioning of large sheets of Neoprene membranes on a roof. The membranes are applied from rolls and the edges of adjoining sheets overlap each other for approximately three or more inches. For purposes of sealing the layers of membrane applied to the roof, it is necessary that the seams of overlapping edges be sealed by a suitable substance, such as a well-known lap sealant. In the past, lap sealants were applied by a roofer manually applying sealant by a caulking gun or other implement. This hand application of lap sealant to seams results in a labor intensive operation that is physically taxing and time consuming to complete. In the past, no suitable lap sealant apparatus has been developed which allows the time and effort of applying lap sealant to be significantly reduced.

SUMMARY OF THE INVENTION

It is therefore an object of this invention to provide and improved apparatus for applying lap sealant.

Another object of this invention is to apply lap sealant through use of a movable vehicle.

A further object of this invention is to improve the accuracy of applying lap sealant to a seam through visual observation by an operator.

Still another object of this invention is to increase the speed at which lap sealant is applied to the seam between adjacent sheets of waterproof membranes.

A still further object of this invention is to reduce the labor and effort required in applying lap sealant to a seam.

These and other objects are attained in accordance with the present invention wherein there is provided an improved apparatus for applying lap sealant. The apparatus is in the form of a hand operated vehicle which can be moved by an operator along a seam. The frame of the apparatus supports a pressurized tank which acts to deliver lap sealant or other similar substance to a work area in an efficient manner as the vehicle is moved along a selected path. A unique nozzle arrangement is supported on the apparatus and extends beyond the side of the vehicle to align the nozzle along the path and permit the operator to apply lap sealant or other substance in an accurate manner. A single operator is capable of applying a sealing substance or other material over greater lengths of travel and in less time using the apparatus of the invention than is remotely possible by using several men applying lap sealant by well-known manual techniques.

DESCRIPTION OF THE DRAWINGS

Further objects of the invention, together with additional features contributing thereto and advantages occurring therefrom, will be apparent from the following description of a preferred embodiment of the invention which is shown in the accompanying drawings with like reference numerals indicating corresponding parts throughout, wherein:

FIG. 1 is a front perspective view of the apparatus for applying lap sealant of the invention;

FIG. 2 is a side schematic view of the apparatus for applying lap sealant to FIG. 1.

DESCRIPTION OF THE PREFERRED EMBODIMENT

Figure 3:
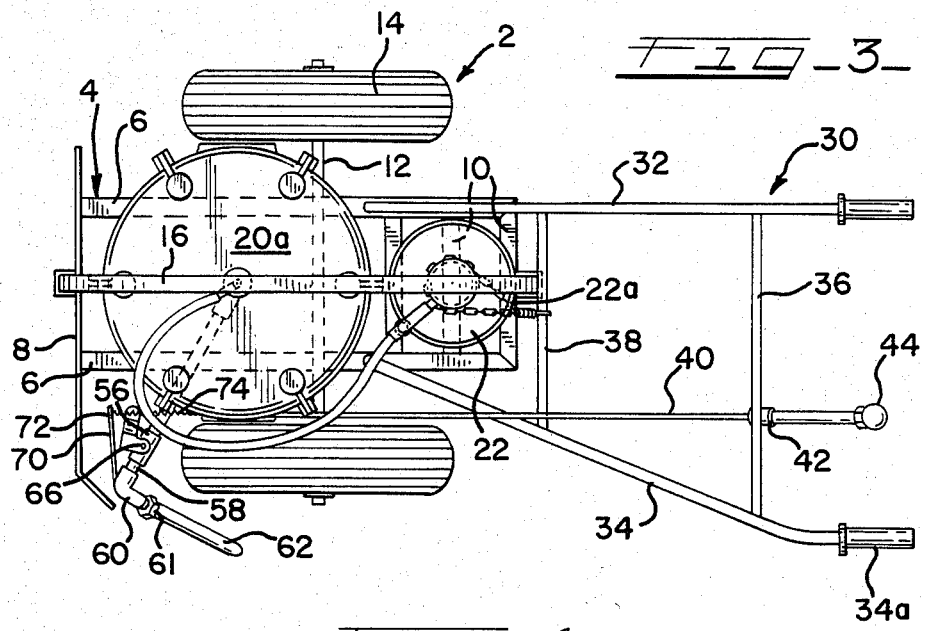
FIG. 3 is a top schematic view of the apparatus for applying lap sealant taken along lines 3—3 of FIG. 2.

Referring now to FIG. 1, there is illustrated a preferred embodiment of the apparatus for applying lap sealant of the invention and generally designated by reference numeral 2. Apparatus 2 is capable of applying lap sealant or other materials of similar consistency to any surface on which the vehicle of the invention may be rolled. The lap sealant is particularly intended for use to seal the seams between adjacent sheets of membrane utilized in roofing systems, linings for tanks, reservoirs and other areas where waterproofing is specifically desirable. One example of a roofing system employing such membranes is manufactured by the Carlyle Tire and Rubber Company of Carlyle, Pa.

The apparatus 2 includes a lower frame 4 comprising a longitudinal pair of elongated square tubing members 6 interconnected by a front bar 8 welded, or otherwise affixed, to the front end of member 6. The rear portion of the tubing 6 is supported by three cross bars 10, also welded or otherwise affixed to the longitudinal members. An axle assembly 12 of conventional design is mounted on the tubular members and rotatably support a pair of pneumatic tires 14 on each side of the vehicle.

As best seen from the side view of FIG. 2, an inverted U-shaped upper frame 16 having a tubular square cross section upstands from the lower frame 4 and is welded to the front bar 8 and one of the rear bars 10. The front and back ends of the U-frame 16 terminate above the surface supporting the wheel 14 in the position shown in FIG. 2 and receive rubber caps 18. The apparatus 2 can be either tilted forward or rearward in a rest position with the rubber cap 18 contacting the support surface. The frame 16 also acts as a protector to the apparatus and further serves as a lifting grap for situations of raising the vehicle to the roof or into transporting vehicles and the like.

The frame 4 supports a pressure pot 20 in which a supply of lap sealant or other material to be applied is introduced. The top 20*a* of the pressure pot is removable to permit the introduction of a supply of sealant into the pot for application to the work area. The cover 20*a* is removably retained to the pot 20 by means of a number of conventional clamp assemblies 20*b*. A follower plate (not shown) is disposed within the pot 20 and floats on top of the caulking compound to prevent the material from vortexing when subjected to pressure when delivering the lap sealant.

A pressure tank 22 is also mounted on the frame 4 by a chain 22*a* and delivers $CO_2$ pressure and the like to the pot 20 through an adjustable pressure regulator 24 and a supply hose 26. Pressure is supplied to the pot by the tank 22 by opening the $CO_2$ cylinder valve 28 and adjusting the flow of gas by means of regulator 24.

Figure 4:
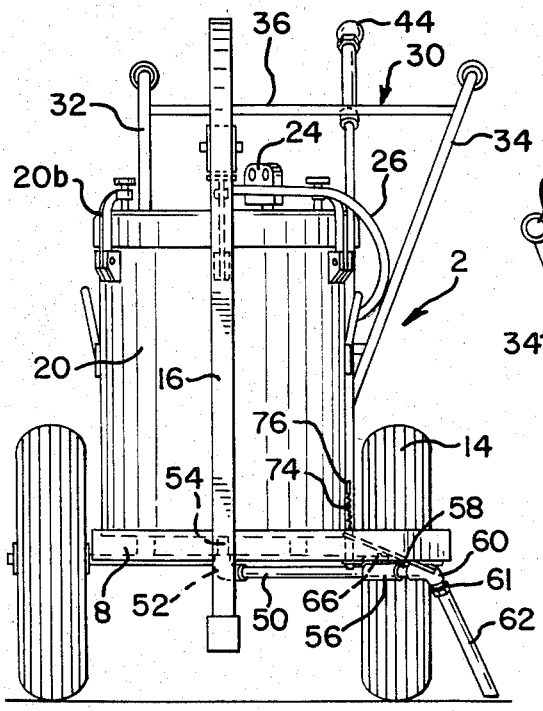
FIG. 4 is a front schematic view taken along the lines 4—4 of FIG. 2.
Figure 5:
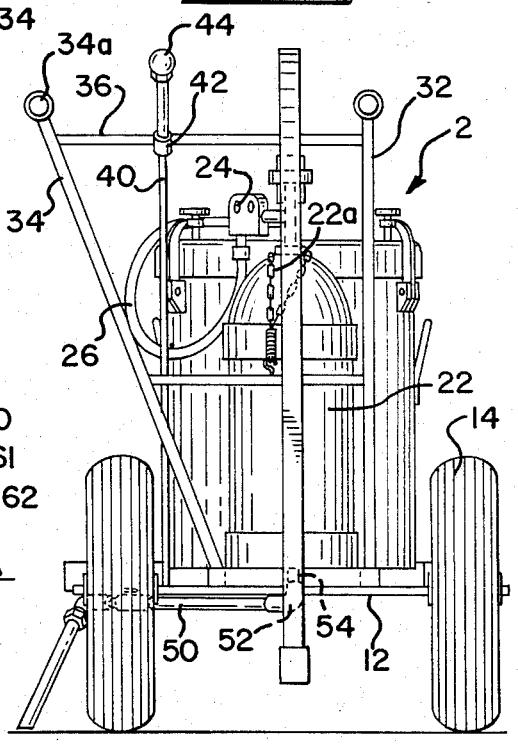
FIG. 5 is a back schematic view taken along the lines 5—5 of FIG. 2.

A handle assembly 32 is affixed to a rear portion of the longitudinal frame 6 and extends upward to the rear of the apparatus to permit the vehicle to be pushed along a work path or to be maneuvered as desired. As best shown in FIG. 3, the frame assembly 30 includes a side handle member 32 and opposite side member 34, both constructed from a tubular member and the like. The handle assembly is strengthened by a pair of cross members 36 and 38, suitably welded to the handle arms 32 and 34. As illustrated in FIGS. 3 and 4, the handle assembly is uniquely designed to allow the operator to observe a delivery nozzle in a more efficient manner and maintain the vehicle along the work path in a precise manner to insure that the seam is accurately followed as sealant and the like is applied. This is partly accomplished by handle 34 projecting outward toward the side of the apparatus 2 and terminating with a handle portion 34*a* lying generally beyond the side near or beyond the side of the wheel 14.

A flow control lever 40 is mounted at its upper end to handle cross member 36 through a sleeve 42 and terminates with a flow control knob 44. The angled bottom end 46 of control lever 40 projects downward and is inserted into the hole of a lever member 48, as best shown in FIG. 1. As seen in FIG. 4, a delivery pipe 50 extends from the bottom of the pressure pot 20 through an elbow 52 and pot connecting portion 54. The pipe 50 projects outward to the inlet of a conventional ball valve assembly 56 having an outer cylindrical housing. The outlet of the ball valve assembly 56 is coupled to a short pipe 58 which, in turn, is connected to a 90° reducing elbow 60.

A plastic male coupling 61 supports a nozzle 62 fabricated from a plastic or metal. The nozzle 62 has a delivery end which is shown in its lowered operative position close to the support surface at an outboard position adjacent one of the wheels 14. As best shown in FIG. 2, the plane of the bottom edge 64 of nozzle 62 is preferably disposed at an angle of approximately 1°-5° to the surface of the support surface, such as formed by a roof, the bottom of a tank, and the like. The nozzle 62 is mounted for up and down movement by swiveling on the joint between the short pipe 58 and the elbow 60 by a conventional technique so that the nozzle may assume the operative position shown in FIG. 2 or the raised position shown in phantom in FIG. 2.

The crank lever 48 is affixed at its opposite end to a flow control knob 66 of valve 56 and turns on the flow of sealant through operation of the lever 40 from a lower position to a pulled-out position shown in FIG. 2. The motion of the lever is transmitted through the crank lever plate 48 to the valve control knob 66. Movement of lever 48 from a lower to a pulled-out position to open the valve 56 not only turns on the flow of sealant, but acts simultaneously to cause the nozzle 62 to pivot downward to the position shown in FIG. 2. This downward movement of the nozzle 62 through movement of the control lever 40 is effected through a linkage bar 70 pivotally attached at one end to the bottom of reducing elbow 60. The opposite inner end of bar 70 is attached by bracket 72 to an elongated tension spring 74 extending upward along the flow control lever 40 and being coupled thereto by means of a bracket 76. Thus, in the lower position of the control knob 40, as shown in phantom in FIG. 2, the nozzle 62 is caused to assume an upper raised position of approximately two inches from what is shown on FIG. 2. This raised position is urged through compression of spring 74 to lift the nozzle 62 through movement of the lever 70. To lower the nozzle 62 to the position of FIG. 2, the lever is pulled up, tensioning the spring 74 and lowering the nozzle. Thus, the flow control lever 40 opens ball valve 56 and the flow of the sealant, but lowers the nozzle tip 64 to the work surface and applies a spring tension to the nozzle tip to apply an even, resilient pressure. The orientation of the nozzle tip 62 with respect to the work surface is such that the nozzle, in effect, floats on the surface of applied material to evenly apply a layer of sealant to the surfaces. The flexing effect of the resiliently mounted nozzle allows for flexing and reduces any likelihood of any damage being made to the rubber roof sheet or flashing materials as a result of the close proximity of the nozzle tip.

In operation, the operator pushes the apparatus along the seam to have material applied. The pressure valve of the tank 22 is turned on, the pressure regulated by regulator 24 and sealant can, thus, be forced out through the outlet pipe 50 at the bottom of the tank. Delivery of the sealant is attained by moving the flow control lever 40 upward to open the ball valve 56, pivot the nozzle 62 and cause a resilient suspending of the nozzle to ride along the seam. The position of the handle assembly 30 insures that the operator has clear view of the sealant being applied and the placement of the nozzle tip at a position in front of the wheel and the center line of the apparatus provides critical maneuverability and the capability of following a seam along its crack with accuracy. Moreover, because the nozzle extends beyond the wheel, flashing can be caulked next to a wall.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for applying a strip of material along a selected work path comprising frame means having a pair of wheels;

said frame means having rear handle means for permitting an operator to move said frame means;

tank means for retaining a supply of material to be applied;

conduit means coupled to said tank means and having a nozzle mounted thereon at a position outboard of one of said wheels;

said nozzle having an upper end portion being pivotally mounted on said conduit means generally about a horizontal axis, said nozzle being pivotally mounted between an upper position and a lower dispensing position;

said nozzle being mounted to assume a material applying position outboard of one of said wheels and to apply a generally continuous strip of material along the work path as the frame means is rolled adjacent the work path;

said nozzle having a lower delivery edge defining a nozzle opening, and said nozzle being free to pivot with respect to said frame means whereby said nozzle lower delivery edge floats on the material being applied when said nozzle is in the lower dispensing position;

valve means connected to said conduit means operative between an open position allowing delivery of material from said supply means to said nozzle and a closed position closing delivery;

a valve control lever connecting said valve means to said handle means for controlling operation of said valve means in either open or closed position;

said nozzle is pivotally mounted for pivotal movement between a lower position corresponding to said material applying position and a raised position, said control lever further coupled to said nozzle for simultaneously causing said valve means to assume said open position and said nozzle means to assume said lowered position.

2. The apparatus according to claim 1 wherein said nozzle is a hollow tube having a delivery end, said delivery end having an edge lying in a plane disposed at an angle of 1°-5° to the path.

3. The apparatus according to claim 1 wherein the nozzle has a lower edge arranged to float on the material being applied during movement of the frame means.

4. The apparatus according to claim 1 wherein said frame includes a handle means angularly oriented relative to said frame means to more generally align the operator along the path while rolling the frame means.

5. The apparatus according to claim 4 wherein said frame means includes a handle portion projecting sideward and aft from the frame means.

6. The apparatus according to claim 1 wherein said nozzle is resiliently coupled to said control lever.

7. The apparatus of claim 6 wherein said nozzle is inclined with its lower delivery edge being directed toward said handle means in said lowered position, said lower delivery edge defining a plan lying at approximately a 1° to 5° slope with respect to said work path in said lowered position.

8. The apparatus of claim 7 wherein said valve control lever is a lever member affixed for rotational movement on said conduit means, said control lever having a first end portion affixed to said handle means, said control lever further having a second end portion connected to a control knob operating said valve means to either said open or said closed position, a connecting member extending between said handle means and said nozzle, a spring disposed between said connecting member and said handle member for resiliently biasing said nozzle, said handle means arranged to simultaneously cause operation of said valve means and said lowering and raising of said nozzle respectively through rotational movement of said control lever and movement of said connecting member.

* * * * *